US008774443B1

(12) United States Patent
Anderson et al.

(10) Patent No.: US 8,774,443 B1
(45) Date of Patent: Jul. 8, 2014

(54) MOBILE PHONE HEADSET RECOIL DEVICE

(76) Inventors: John C. Anderson, Tampa, FL (US); Benjamin Anderson, Tampa, FL (US)

( * ) Notice: Subject to any disclaimer, the term of this patent is extended or adjusted under 35 U.S.C. 154(b) by 198 days.

(21) Appl. No.: 13/114,848

(22) Filed: May 24, 2011

Related U.S. Application Data

(60) Provisional application No. 61/347,683, filed on May 24, 2010.

(51) Int. Cl.
*H04R 25/00* (2006.01)
*B65H 75/48* (2006.01)

(52) U.S. Cl.
USPC ..... 381/375; 381/379; 381/383; 242/378.4

(58) Field of Classification Search
CPC ... H04M 1/05; H04R 2201/107; H04R 1/083; H04R 1/1008; B60R 2022/3424; B60R 22/40; H02G 11/02
USPC ..... 242/378.4; 381/375, 379, 383
See application file for complete search history.

(56) References Cited

U.S. PATENT DOCUMENTS

| | | | | | |
|---|---|---|---|---|---|
| 3,798,389 | A | | 3/1974 | Tokizaki | |
| 3,984,645 | A | | 10/1976 | Kresch | |
| 4,653,833 | A | * | 3/1987 | Czubernat et al. | 439/528 |
| 4,942,617 | A | | 7/1990 | Boylan | |
| 5,339,461 | A | * | 8/1994 | Luplow | 455/351 |
| 5,422,957 | A | | 6/1995 | Cummins | |
| 5,544,836 | A | * | 8/1996 | Pera | 242/372 |
| 5,588,626 | A | * | 12/1996 | Yang | 242/378.1 |
| 5,684,883 | A | * | 11/1997 | Chen | 381/385 |
| 5,832,098 | A | * | 11/1998 | Chen | 381/370 |
| 6,059,213 | A | * | 5/2000 | Phillips | 242/378.4 |
| 6,250,578 | B1 | * | 6/2001 | Manda | 242/378.1 |
| 6,446,898 | B1 | * | 9/2002 | Hwang | 242/378.1 |
| 6,480,611 | B2 | | 11/2002 | Hashimoto et al. | |
| 6,616,080 | B1 | * | 9/2003 | Edwards et al. | 242/378.1 |
| 6,644,582 | B1 | * | 11/2003 | Liao | 242/378.1 |
| 6,866,219 | B2 | * | 3/2005 | Wei | 242/378.4 |
| 6,874,722 | B2 | * | 4/2005 | Wei | 242/378 |
| 7,328,868 | B2 | * | 2/2008 | Liao | 242/378.1 |
| 7,389,955 | B2 | * | 6/2008 | Liao | 242/378.1 |
| 7,661,567 | B2 | * | 2/2010 | Myers | 224/217 |
| 2002/0023814 | A1 | * | 2/2002 | Poutiatine | 191/12.2 R |
| 2005/0220316 | A1 | * | 10/2005 | Hsiang | 381/315 |
| 2006/0243845 | A1 | * | 11/2006 | Wegner | 242/378.1 |
| 2008/0132293 | A1 | * | 6/2008 | Gundlach et al. | 455/569.1 |
| 2011/0130174 | A1 | * | 6/2011 | Kroupa | 455/569.1 |
| 2011/0203954 | A1 | * | 8/2011 | Kroupa | 206/320 |
| 2012/0153065 | A1 | * | 6/2012 | Fischer | 242/379 |

* cited by examiner

*Primary Examiner* — Duc Nguyen
*Assistant Examiner* — Sean H Nguyen
(74) *Attorney, Agent, or Firm* — Robert C. Montgomery; Montgomery Patent & Design

(57) ABSTRACT

An enclosure which provides a storage of mobile phone headset cables as well as a means to extend and retract said headset cables is disclosed. The enclosure allows the headset cables to be wound internally onto a large diameter reel while a mobile phone connecting cable is wound onto a smaller spool, thereby allowing a greater length of headset cables to be extended. A button enables said cables to be retracted to eliminate slack while the device is in use, or to completely retract the cables when the device is disconnected from the phone. The retracted cable portions may be contained within the enclosure which further comprises a plurality of nests along external surfaces for the storage of ear buds, a microphone, and the phone connection plug in a flush manner, thereby avoiding the entanglement of exposed loose cables.

18 Claims, 7 Drawing Sheets

MOBILE PHONE HEADSET RECOIL DEVICE

RELATED APPLICATIONS

The present invention was first described in and claims the benefit of U.S. Provisional Application No. 61/347,683 filed May 24, 2010, the entire disclosure of which is incorporated herein by reference.

FIELD OF THE INVENTION

The present invention relates generally to a headset for a mobile phone, and in particular, to a headset for a mobile phone with a retractable earphone and plug construction.

BACKGROUND OF THE INVENTION

Many people have grown accustomed to the convenience afforded by wireless cellular telephones. Many people, including young children, carry a cellular phone on their person at all times or know where they can get their hands on one at all times. To further the functionality of such phones, manufacturers have recently added the ability to sync a wireless headset using a BLUETOOTH® connection or equivalent protocol.

Even with the availability of such wireless earpieces, many users prefer wired headphone solutions due to their reduced RF exposure, higher fidelity, lower cost, and ease of use.

One (1) drawback associated with the use of wired headphones is that the cord is unruly and annoying to manage when not in use. Many users place the headphones into a pocket or purse where they become knotted up. This causes difficulty the next time they headphones are need, and can damage the headphones and wiring over a long period.

In some cases, to avoid tangling, the cord is just left dangling from the user's head even while they are not using it. This has obvious downsides such as posing safety hazards, diminishing the user's ability to hear environmental sounds, looking strange, and increasing likelihood of damage to the headphones due to contact or snagging.

Various attempts have been made to provide cord take-up devices for earphones. Examples of these attempts can be seen by reference to several U.S. patents, including U.S. Pat. No. 3,798,389; U.S. Pat. No. 4,942,617; U.S. Pat. No. 5,422,957; U.S. Pat. No. 5,684,883; U.S. Pat. No. 5,832,098; and U.S. Pat. No. 6,480,611. However, none of these designs is similar to the present invention.

While these devices fulfill their respective, particular objectives, each of these references suffer from one (1) or more of the aforementioned disadvantages. Many such devices are not sized or designed for constant comfortable connection to a cellular phone or similar device. Many such devices do not work with a wide range of audio devices. Many such devices do not provide convenient attachment or carrying means adaptable to a user's preferences and particularly suited for portable connection to a cellular phone. Many such devices do not include provisions for microphone assemblies as are necessary for cellular phone compatible headsets. Many such devices do not provide convenient concurrent operation of headphones, microphones, and plug assemblies in a quick and ergonomic manner. Accordingly, there exists a need for a recoil device for mobile phone headsets without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a recoil device for mobile phone headsets that is easily carried and connected to an existing mobile phone or other audio device in a manner which is adjustable, automatic, low-maintenance, and convenient before, during and after use. Thus, the object of the present invention is to solve the aforementioned disadvantages and provide for this need.

To achieve the above objectives, it is an object of the present invention to extend and automatically retract headset cables and provide a discreet and tangle-free means to store a phone plug, ear buds, and microphone. The device has an enclosure body with a plurality of form-fitting recessed areas that receive and retain the phone plug, ear buds, and microphone.

Another object of the present invention is to connect to an existing mobile phone or other compatible audio device such as an MP3 player, CD player, walkie-talkie, or the like using the plug.

Yet still another object of the present invention is to provide a spring-loaded internal flanged reel enabling coincidental winding and retracting of a plug cable and ear bud cables and an integrally-molded cable groove that retains a cable between the ear bud and microphone.

Yet still another object of the present invention is to allow two (2) spools of the reel to rotate as a single unit around a stationary axle, with the ear bud cables about a first spool and the plug cable about a second spool. The first spool also has a positive diametrical ratio compared to the second spool so that the ear bud cables are extended at a faster rate than the plug cable. When the plug cable is attached to a belt or similar area, a short length of plug cable is provided providing a low-slack length of cable to the phone while the ear bud cables have a greater length suitable for reaching the user's ears.

Yet still another object of the present invention is to provide a ratchet and a pawl mechanism that automatically lock the ear bud cables and plug cable in a deployed position. This allows the user to continuously use the device at their desired deployed length.

Yet still another object of the present invention is to provide a pushbutton that retracts the pawl mechanism, thereby releasing the reel and causing the spring to automatically retract and wind the cables. In this manner, the user can quickly and automatically return the device to a compact, undeployed state.

Yet still another object of the present invention is to provide grommets along the enclosure body that provide protection to the cables during extension and retraction to reduce abrasion damage to the cables.

Yet still another object of the present invention is to provide a belt clip that can be used to removably attach the device to a belt, garment, or other similar location.

Yet still another object of the present invention is to provide a method of utilizing the device that provides a unique means of procuring a model of the device, attaching a mobile phone and the device in close proximity, the plug cable, first cable, and second cable simultaneously away from the enclosure body until a desired extended length is obtained, removing excessive slack in the cables, if desired, by pressing the pushbutton, utilizing the mobile phone in a hands-free manner, and automatically retracting the cables into the enclosure body by pressing and holding the pushbutton after use.

Further objects and advantages of the present invention will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

| DESCRIPTIVE KEY | |
|---|---|
| 10 | mobile phone headset recoil device |
| 11 | enclosure body |
| 12 | enclosure cover |
| 13 | fastener |
| 14 | belt clip |
| 15 | pushbutton |
| 16 | stationary axle |
| 17 | name plate |
| 18 | reel release mechanism |
| 19 | pawl mechanism |
| 20 | rivet |
| 21 | plug |
| 22 | first ear bud |
| 23 | second ear bud |
| 24 | microphone |
| 25 | reel |
| 26 | first flange pair |
| 27a | second flange |
| 27b | tooth |
| 28a | first spool |
| 28b | second spool |
| 29 | third flange pair |
| 30 | grommet |
| 31 | first nest |
| 32 | second nest |
| 33 | third nest |
| 34 | fourth nest |
| 35 | guide tube |
| 36 | first spring |
| 37 | second spring |
| 38 | recess |
| 40 | pin |
| 41 | plug cable |
| 42 | first cable |
| 43 | second cable |
| 44 | cable groove |
| 46 | connecting aperture |

DETAILED DESCRIPTION OF THE PREFERRED EMBODIMENT

Figure 1:
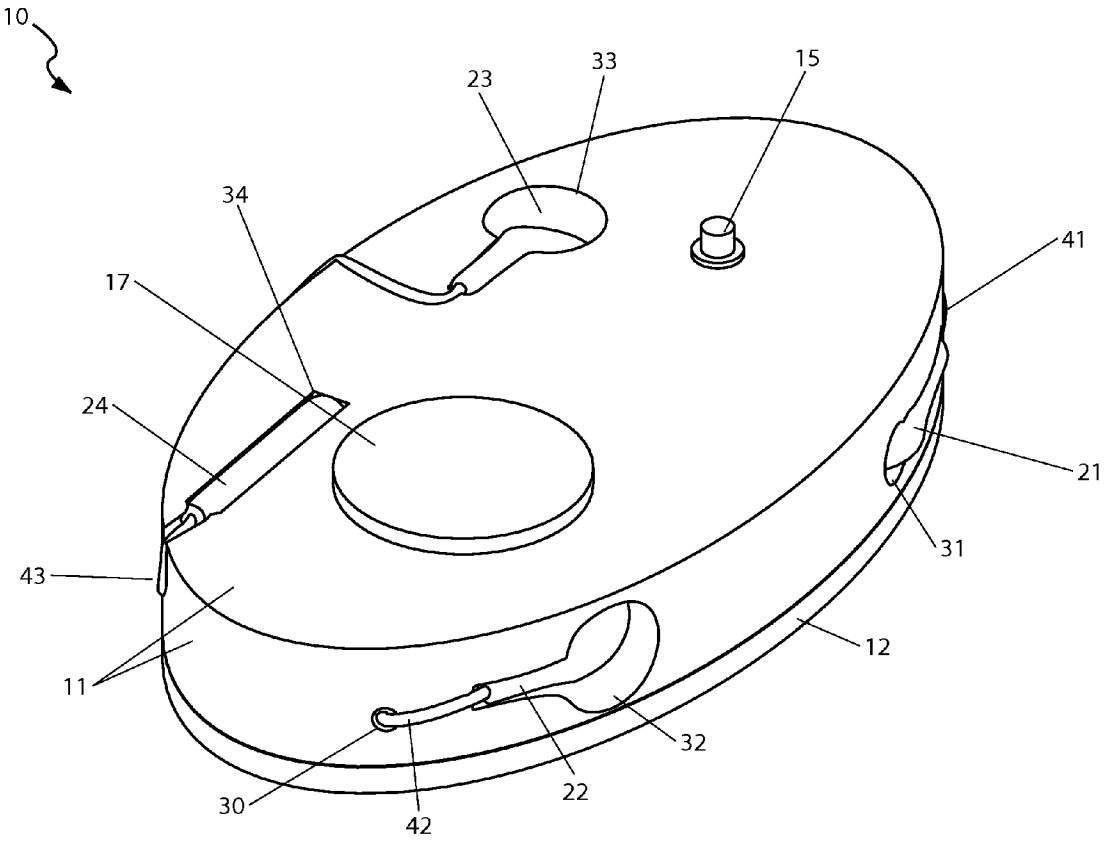
FIG. 1 is a perspective view of a mobile phone headset recoil device 10, according to a preferred embodiment of the present invention.
Figure 2A:
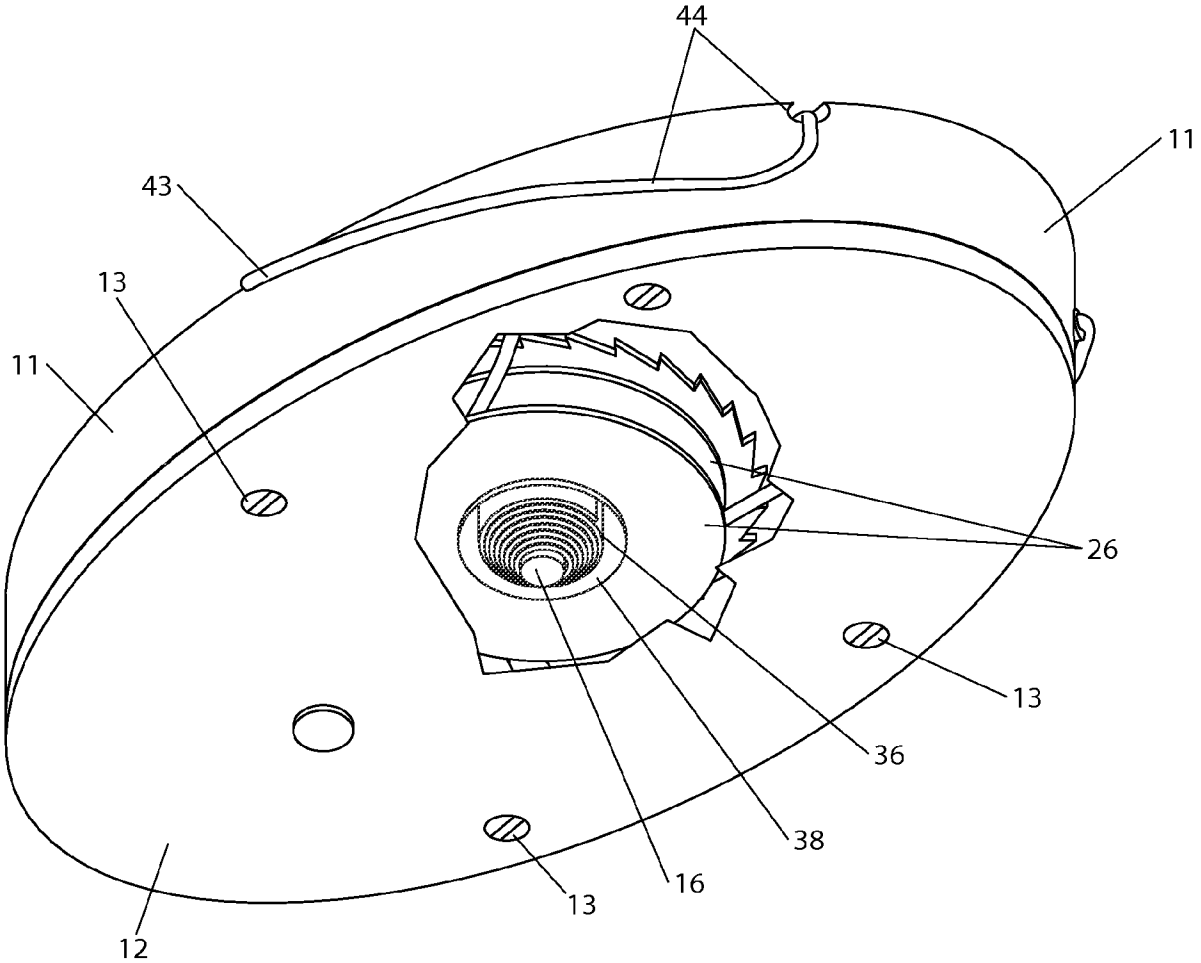
FIG. 2*a* is a partial cut-away bottom perspective view of the mobile phone headset recoil device 10, according to the preferred embodiment of the present invention.
Figure 2B:
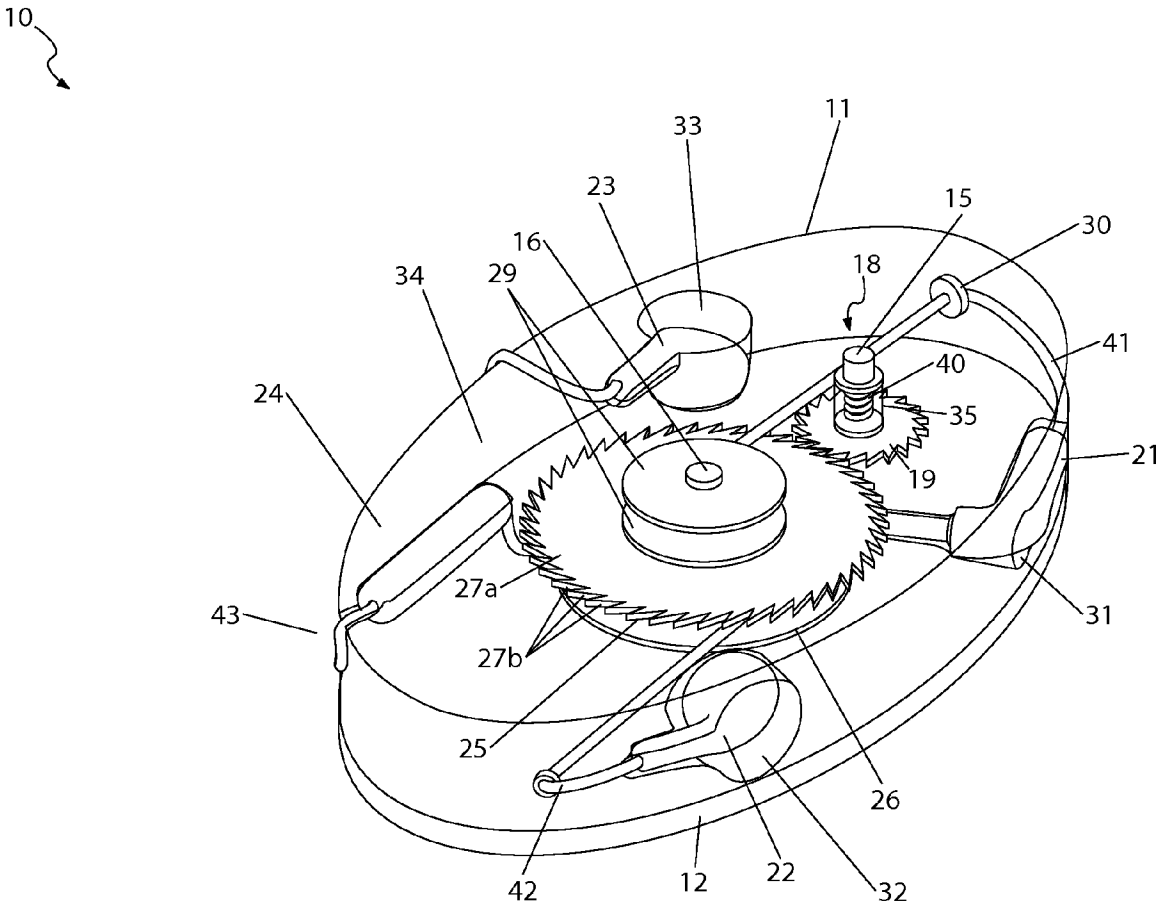
FIG. 2*b* is a transparent perspective view of the mobile phone headset recoil device 10, according to the preferred embodiment of the present invention.
Figure 2C:
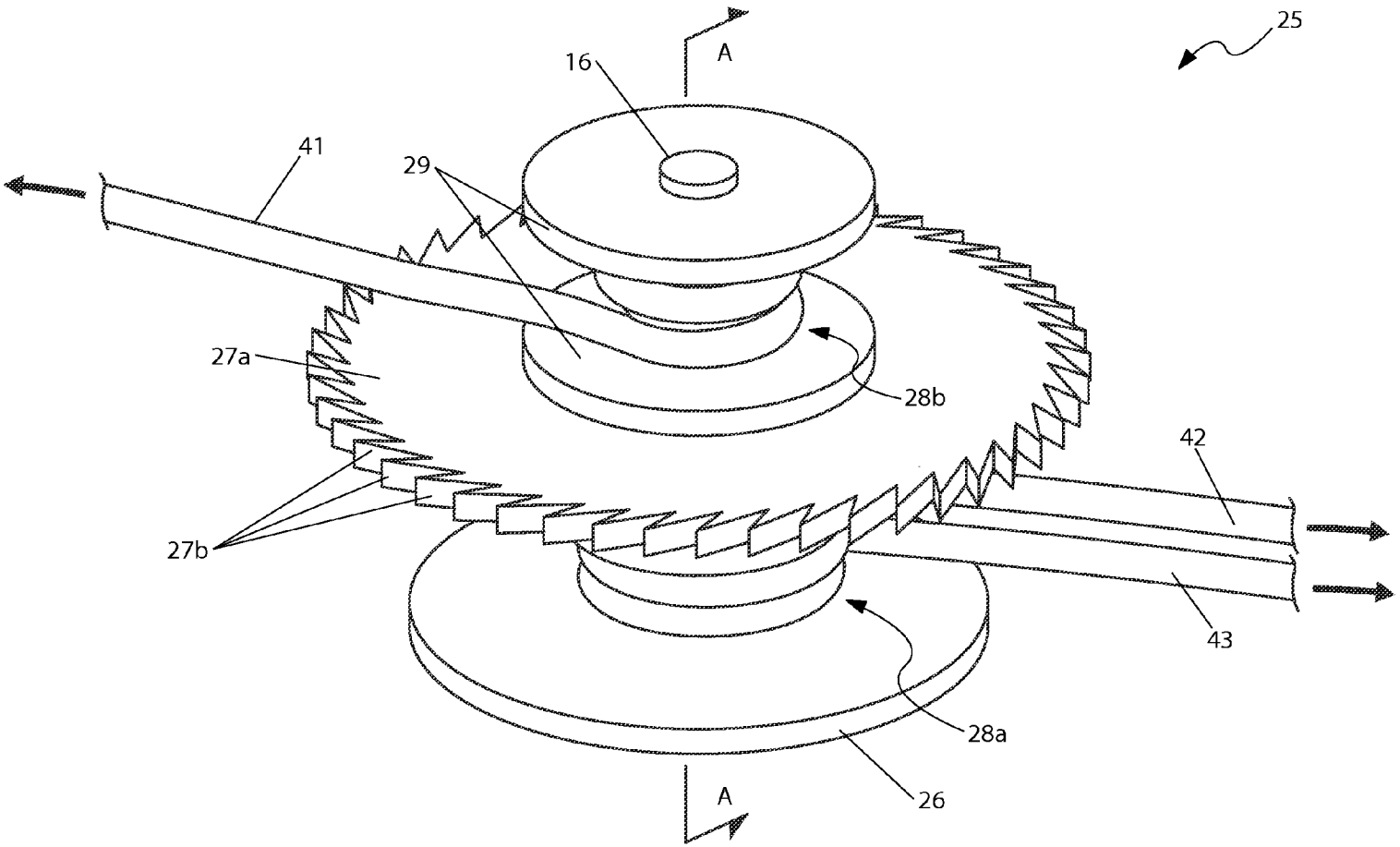
FIG. 2*c* is an isolated close-up view of a reel portion 25 of the mobile phone headset recoil device 10, according to the preferred embodiment of the present invention.
Figure 2D:
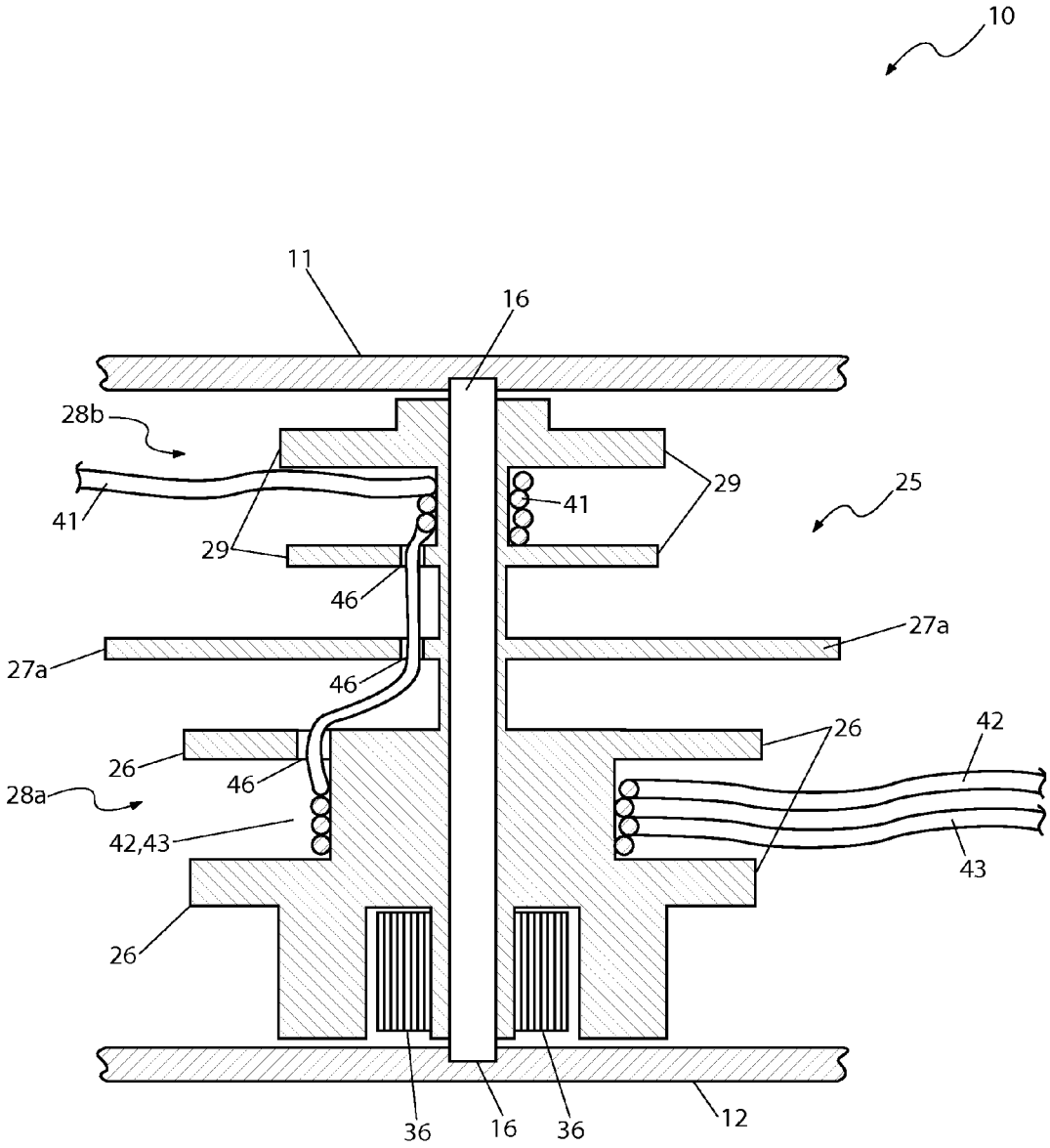
FIG. 2*d* is a section view of the reel portion 25 of the mobile phone headset recoil device 10 taken along section line A-A (see FIG. 2*c*), according to the preferred embodiment of the present invention.
Figure 2E:
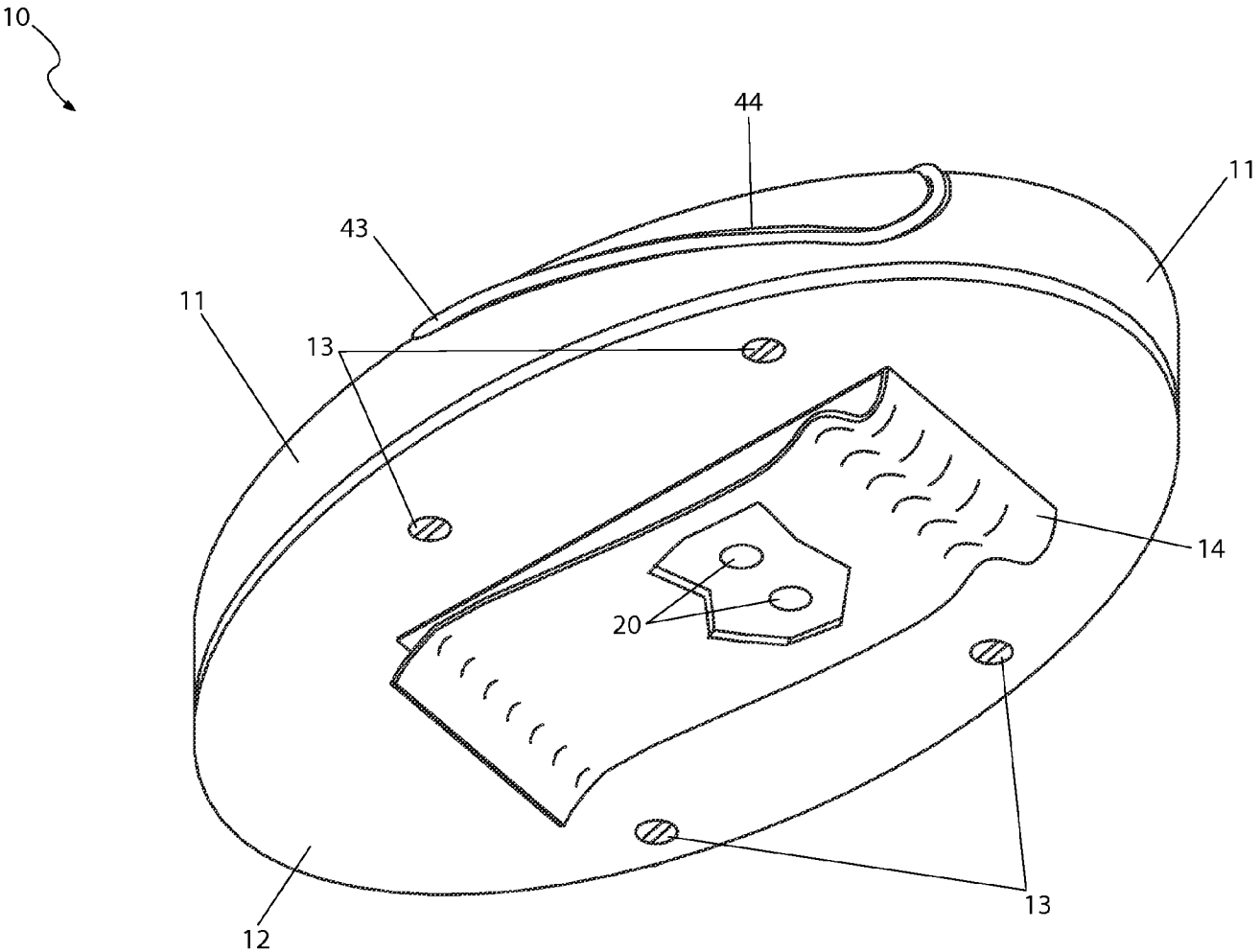
FIG. 2*e* is a bottom perspective view of the mobile phone headset recoil device 10 depicting a belt clip portion 14, according to the preferred embodiment of the present invention; and, FIG. 3 is a perspective top view of the mobile phone headset recoil device 10 depicted in a state in which the cables 41, 42, and 43 are extended, according to the preferred embodiment of the present invention.
Figure 3:
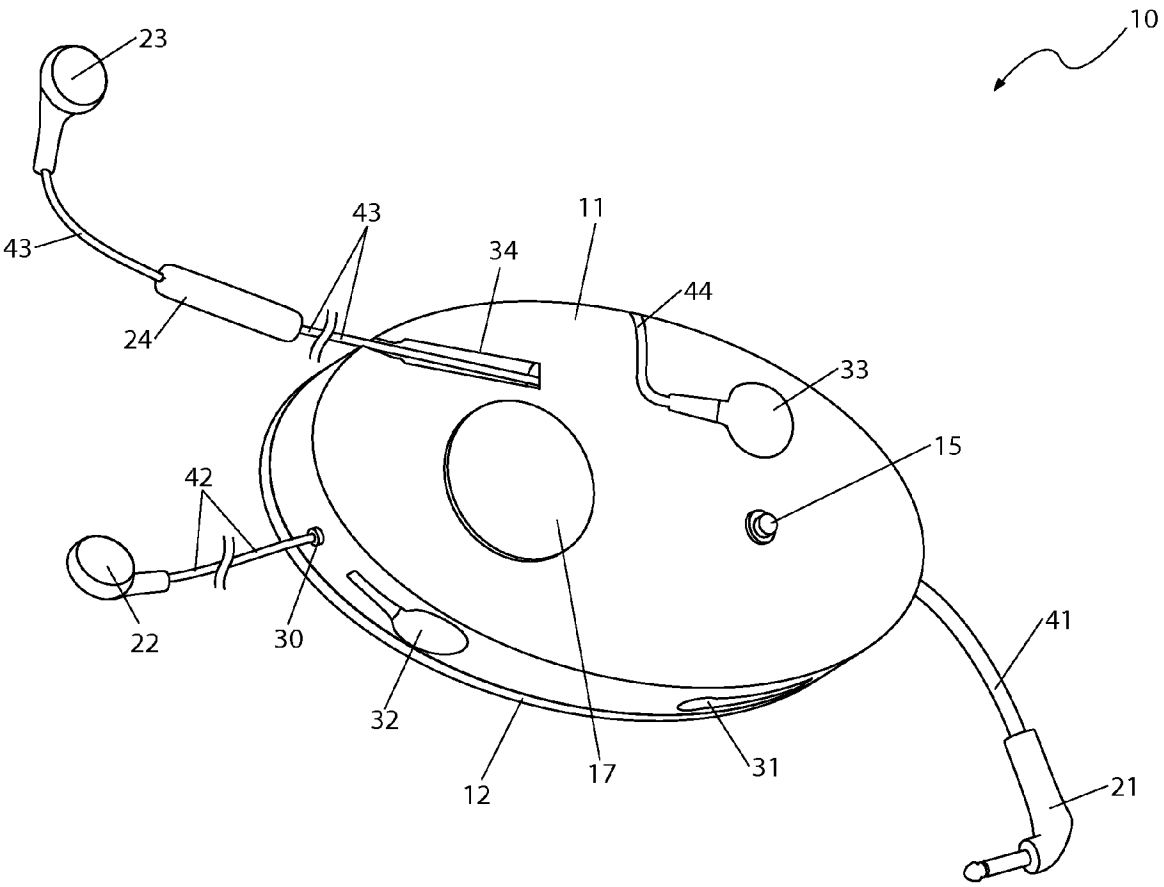

In accordance with the invention, the best mode is presented in terms of a preferred embodiment, herein depicted within FIGS. 1 through 3. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

The present invention describes a mobile phone headset recoil device (herein described as the "device") 10, which provides a means for extending and retracting headset cables for use with an existing mobile phone.

Referring now to FIG. 1, a perspective top view of a device 10, according to the preferred embodiment of the present invention, is disclosed. The device 10 provides a means for extending and retracting headset cables and comprises a small cylindrical or ovular-shaped enclosure body 11 having a flat enclosure cover 12 to enclose a bottom opening portion of said enclosure body 11. The device 10 further comprises a pushbutton 15 and a name plate 17. The device 10 provides a discreet and tangle-free means to store a phone plug 21, a first ear bud 22, a second ear bud 23, and a microphone 24. The enclosure body 11 provides a means to secure and store said plug 21, ear buds 22, 23, and microphone 24 portions in an approximate flush-mount manner within a plurality of snug form-fitting recessed areas molded into outer surfaces of said enclosure body 11. As illustrated here, the plug 21 is stored within a first nest 31, the first ear bud 22 is stored within a second nest 32, the second ear bud 23 is stored within a third nest 33, and the microphone 24 is stored within a fourth nest 34. Said nests 31, 32, 33, 34 comprise recessed molded features being shaped so as to provide slight retaining interference with said corresponding plug 21, buds 22, 23 and microphone 24 portions at or slightly below side and top surfaces of the enclosure body 11.

The enclosure body 11 and the enclosure cover 12 are envisioned to be manufactured as plastic moldings and introduced in various attractive colors and patterns. The name plate 17 is envisioned being a painted or molded-in feature of the enclosure body 11 which communicates various indicia such as product identification, logos, personal identification, and the like.

The device 10 is preferably utilized in conjunction with an existing mobile phone; however, it is understood that the device 10 and included cable 41, 42, 43, ear bud 22, 23, and microphone 24 portions may be utilized with other compatible audio devices such as MP3 players, CD players, walky-talky devices, and the like, with equal benefit, and as such should not be interpreted as a limiting factor of the device 10.

Referring now to FIG. 2*a*, a partially cut-away perspective bottom view of the device 10, according to the preferred embodiment of the present invention, is disclosed. The enclosure cover portion 12 of the device 10 is fastened onto a bottom opening portion of the enclosure body 11 using a plurality of fasteners 13 such as screws, rivets, or the like. The device 10 further comprises an internal flanged reel 25 further comprising a cylindrical recess portion 38 along a bottom surface containing a spiraled coil-type first spring 36. An outer end portion of said first spring 36 is permanently fastened onto a perimeter surface of the recess 38, while an inner end portion of said first spring 36 is permanently fastened onto a central stationary axle portion 16 which extends vertically along a center of said reel 35 and is attached to a top inner surface of the enclosure body 11 and an inner surface of the enclosure cover 12. The rotation of the reel 25 upon said stationary axle 16 by the first spring 36 enables coincidental winding and retracting of a plug cable 41 portion of the plug 21, a first cable 42 portion of the first ear bud 22, and a second cable 43 portion of the second ear bud 23. Preferably, the first cable 42 and the second cable 43 are a bifurcated portion of a shared cable assembly with the plug cable 41.

The enclosure body 11 provides a means to discreetly secure and contain a length of the second cable 43 located between the second ear bud 23 and the microphone 24, along a side surface of said enclosure body 11 via an integrally-molded cable groove 44. Said cable groove 44 comprises a groove having a generally semi-circular cross section and being sized so as to snuggly retain said second cable 43 allowing insertion in a manner which is approximately flush with said outside surface of the enclosure body 11.

Referring now to FIGS. 2*b*, 2*c*, and 2*d*, transparent, perspective, and section views of the device 10 depicting the reel portion 25, according to the preferred embodiment of the present invention, are disclosed. The reel portion 25 of the device 10 comprises coaxial integral members including a first flange pair 26 which defines a first spool 28*a*, a second flange 27*a*, and a third flange pair 29 which defines a second spool 28*b*. The first spool 28*a* comprises a large diameter portion of the reel 25 while the second spool 28*b* defines a small diameter portion of said reel 25. The coaxial arrangement of the spools 28*a*, 28*b* upon the reel 25 allow both the reel 25 and the spools 28*a*, 28*b* to rotate as a single unit around the stationary axle 16. Correspondingly, the first 42 and second 43 cables are concurrently wound onto the larger first spool 28*a* between the first flange pair 26, while the plug cable 41 is coincidentally wound onto the smaller second spool 28*b* between the third flange pair 29. The diametrical ratio of the first spool 28*a* with regards to the second spool 28*b* is to be approximately four (4) to one (1), thereby extending the first 42 and second 43 cables at a linear rate of approximately four (4) times that of the plug cable 41. This feature allows the enclosure body portion 11, being attached to a belt, to extend a short length of plug cable 41 for normal connection to an adjacent cell phone, while a longer length of the first 42 and second 43 cables is extended to a user's ear area. The inner end portions of the plug cable 41, the first cable 42, and the second cable 43 are envisioned to be routed from the first spool 28*a* to the second spool 28*b* through a plurality of connecting apertures 46 passing through an innermost one (1) of said first flange pair 26, the second flange 27*a*, and an innermost one (1) of said third flange pair 29 portions of the reel 25. Said connecting apertures 46 provide electrical communication between the plug cable 41 and both first 42 and second 43 cables. Said connecting apertures 46 also avoid detachment of said cables 41, 42, 43 when fully extended.

The second flange 27*a* is positioned between the first 28*a* and second 28*b* spools and having a perimeter edge comprising a plurality of ratchet teeth 27*b* which engage a pawl mechanism portion 19 of a reel release mechanism 18. The reel release mechanism 18 further comprises a vertical pin 40 having an integral pushbutton 15 at a top end portion which protrudes upwardly through a top surface of the enclosure body 11. The pushbutton portion 15 is spring-loaded in an upward direction via a second spring 37 which encompasses the pin 40. Said second spring 37 is supported and housed within a hollow cylindrical guide tube 35 being integral to, and extending downwardly from an inner surface of the enclosure body 11. The pawl mechanism 19 is also integrated into the pin 40 at a bottom end portion. The second spring 37 biases the pawl mechanism 19 against the ratchet teeth 27*b* of the second flange 27*a*, thereby securing the cables 41, 42, 43 at various desired lengths. The ratcheting interaction of the pawl mechanism 19 and the teeth 27*b* allow the cables 41, 42, 43 to be manually extended away from the enclosure body 11 and locked at said desired extended length. Extending the cables 41, 42, and 43 causes the reel 25 and spool 28 to rotate in a clockwise direction, thereby winding up the first spring 36 (see FIG. 2*a*). A downward push onto the pushbutton 15 disengages the pawl mechanism 19 from the ratchet teeth 27*b* of the second flange 27*a*, thereby causing the first spring 36 to rotate the reel 25 and integral spool portions 28*a*, 28*b* to simultaneously retract the cables 41, 42, 43 for storage or to remove slack.

Furthermore, the enclosure body 11 comprises a plurality of captivated spool-shaped plastic or rubber grommets 30, one (1) being at each location where a cable 41, 42, 43 penetrates and exits said enclosure body 11, thereby providing protection against abrasion damage during extension and retraction of said cables 41, 42, 43.

Referring now to FIG. 2*e*, a bottom perspective view of the mobile phone headset recoil device 10 depicting a belt clip portion 14, according to the preferred embodiment of the present invention, is disclosed. The belt clip 14 comprises a "U"-shaped portion of spring steel affixed to the enclosure cover 12 using a pair of rivets 20, further comprising a protruding arcuate portion to facilitate fastening onto a structure such as a user's belt.

Referring now to FIG. 3, a perspective top view of the device 10 depicted in a state wherein the plug cable 41, the first cable 42, and the second cable 43 are extended outwardly, according to the preferred embodiment of the present invention, is disclosed. The extended outer end portion of the plug cable 41 provides the integral plug 21 which is envisioned to provide a standard phone connector. An extended outer end portion of the first cable 42 comprises an integrated first ear bud 22, and the extended outer end portion of the second cable 43 comprises an integrated second ear bud 23. An intermediate portion of the second cable 43 further comprises a microphone 24. The first cable 42 and the second cable 43 are concurrently wound onto the first spool portion 28*a* of the reel 25 in a manner wherein the deployed length of the first cable 42 is equal to the deployed length of the second cable 43. The integral configuration of the reel 25 allows the plug cable 41, the first cable 42 and the third cable 43 to be extended and retracted simultaneously. The smaller diameter first spool 28*a* is intended to provide a shorter extended length for the plug cable 41 relative to the extended length of the first 42 and second 43 cables, thereby allowing for a shorter distance between the device 10 and the receptacle of the mobile phone, as compared to a longer distance between the device 10 and a user's ears when the device 10 is fastened onto a user's belt.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be received in a retracted and stored state as indicated in FIG. 1 and utilized in an extended state as indicated in FIG. 3.

The method of utilizing the device 10 may be achieved by performing the following steps: procuring a model of the device 10 having a desired color; selecting desired locations on the user's belt to attach a mobile phone and the device 10; attaching the mobile phone at said desired location upon the belt; attaching the device 10 in close proximity to said mobile phone upon the user's belt using the belt clip 14; extracting the plug 21, the first ear bud 22, the second ear bud 23, and the microphone 24 from respective recessed first nest 31, second nest 32, third nest 33, and fourth nest 34 features; grasping the plug cable 41 using one (1) hand while using the remaining hand to grasp the first cable 42 and the second cable 43; extending the plug cable 41, first cable 42, and second cable 43 simultaneously away from the enclosure body 11 until obtaining a desired extended length of the first 42 and second 43 cables, thereby enabling comfortable insertion of the first 22 and second 23 ear buds into one's ears; inserting the first ear bud 22 into a user's ear; inserting the second ear bud 23 into the user's opposite ear; inserting the plug 21 into the mobile phone receptacle; removing excessive slack in the first 42 and second 43 cables, if desired, by pressing the pushbutton 15 inward and allowing partial retraction of said cables 42, 43; utilizing the mobile phone in a hands-free manner as needed; disconnecting the plug 21 and removing the ear buds 22 and 23 from the user's ears when finished using the mobile phone in a hands-free state; retracting the cables 41, 42, 43 into the enclosure body 11 by pressing and holding the pushbutton 15; returning the device 10 to a stored state by inserting the plug 21 into the first nest 31; inserting the microphone 24 into the fourth nest 34; inserting the second ear bud 23 into the third nest 33; inserting the portion of the second cable 43 between the microphone 24 and the second ear bud 23 into the cable groove 44; storing the first ear bud 22 within the second nest 32; and, storing the device 10 in a pocket, purse, or other suitable location.

The foregoing descriptions of specific embodiments have been presented for purposes of illustration and description. They are not intended to be exhaustive or to limit the invention and method of use to the precise forms disclosed. Various modifications and variations can be appreciated by one skilled in the art in light of the above teachings. The embodiments have been chosen and described in order to best explain the principles and practical application in accordance with the invention to enable those skilled in the art to best utilize the various embodiments with expected modifications as are suited to the particular use contemplated. It is understood that various omissions or substitutions of equivalents are contemplated as circumstance may suggest or render expedient, but is intended to cover the application or implementation without departing from the spirit or scope of the claims of the invention.

What is claimed is:

1. A headset recoil device, comprising:

an enclosure body with a removably attachable cover to enclose a bottom opening portion of said enclosure body, further comprising a plurality of nests located along an outer surface of said enclosure body;

an electronic device interface removably secured within one of said plurality of nests, further comprising an electronic device cable;

a first ear bud removably secured within one of said plurality of nests, further comprising a first cable;

a second ear bud removably secured within one of said plurality of nests, further comprising a second cable;

a microphone removably secured within one of said plurality of nests and in electrical communication with said second cable;

a unitary reel portion disposed within said enclosure body simultaneously and operably connected to said electronic device interface, said first ear bud, said second ear bud, and said microphone; and, a reel release mechanism operably connected to said reel portion;

wherein said first cable and said second cable are separate and in simultaneous electrical communication with said electronic interface cable;

wherein each of said first ear bud, said second ear bud, and said microphone are in simultaneous electrical communication with an electronic device when said electronic device interface is removably attached to and in electrical communication with said electronic device;

wherein each of said electronic device interface, said first ear bud, said second ear bud, and said microphone are simultaneously secured within one of said plurality of nests when each of said plug, said first ear bud, said second ear bud, and said microphone are in said fully retracted state;

wherein said reel portion simultaneously and adjustably lengthens and retracts each of said electronic device interface, said first ear bud, said second ear bud, and said microphone between a fully retracted state and a fully extended state;

wherein said reel portion adjustably simultaneously secures each of said electronic device interface, said first ear bud, said second ear bud, and said microphone to a desired length; and, wherein said reel release mechanism simultaneously releases each of said electronic device interface, said first ear bud, said second ear bud, and said microphone from said desired length to said fully retracted state.

2. The device of claim 1, further comprising a name plate located on an outer surface of said cover.

3. The device of claim 1, wherein said enclosure body further comprises:

a cable groove located along a side surface of said enclosure body between a pair of said plurality of nests securing said second ear bud and said microphone therein, said cable groove retaining said second cable therein; and, wherein each of said plurality of nests comprise recessed molded features being shaped so as to provide a retaining interference with each of said corresponding electronic device interface, said first ear bud, said second ear bud, and said microphone portions at or slightly below side and top surfaces of the enclosure body.

4. The device of claim 1, further comprising a plurality of grommets each having a protective bumper located where each of said electronic device cable, said first cable, said second cable enters and exits said enclosure body.

5. The device of claim 1, wherein said reel portion further comprises:

a cylindrical recess portion along a bottom surface;

a stationary axle portion extending vertically along a center axis of and affixed to a top inner surface of said enclosure body and an opposing inner surface of said cover; and, a first spring having an outer end portion affixed to a perimeter surface of said recess and an inner end portion of said first spring affixed to said stationary axle portion;

wherein rotation of said reel portion upon said stationary axle enables coincidental motioning of each of said electronic device interface, said first ear bud, said second ear bud, and said microphone between said fully retracted state and said fully extended state.

6. The device of claim 5, wherein said unitary reel portion further comprises:

a first spool, comprising a first flange pair; and, a second spool, comprising a second flange and a third flange pair;

a plurality of connecting apertures located on an innermost one of said first flange pair, said second flange, and an innermost one of said third flange pair;

wherein said first spool comprises a diameter larger than a diameter of said second spool;

wherein said first cable and said second cable are coincidentally wound onto said larger first spool between said first flange pair;

wherein said electronic device cable is wound onto said second spool between said third flange pair;

wherein said electronic interface cable and said first cable and said second cable are routed through said plurality of connecting apertures to provide an anchoring and securing means for each of said electronic interface cable, said first cable, and said second cable;

wherein said connecting apertures prevent detachment of said electronic interface cable, said first cable, and said second cable when in said fully extended state;

wherein said second flange is in mechanical communication with said reel release mechanism.

7. The device of claim 6, wherein said reel release mechanism further comprises:

a pin, having a pushbutton located at a top end thereof, said pushbutton extending through an upper wall of said enclosure body and outward therefrom;

a second spring encompassing a lower portion of said pin, residing within a guide tube extending downward from an inner surface of said enclosure body, said second spring biasing said pushbutton upwardly;

a pawl mechanism located at a bottom end of said pin and in mechanical communication with said second flange;

wherein depression of said pushbutton disengages said pawl mechanism from said second flange, thereby enabling said reel portion to return each of said electronic device cable, said first cable, and said second cable to said fully retracted state.

8. The device of claim 7, wherein said second flange and said pawl mechanism each further comprise a plurality of ratchet teeth located along an outer circumference.

9. The device of claim 8, wherein a diametrical ratio between said first spool to said second spool is approximately 4:1.

10. A headset recoil device, comprising:

an enclosure body with a removably attachable cover to enclose a bottom opening portion of said enclosure body, further comprising a plurality of nests located along an outer surface of said enclosure body;

a belt clip affixed to said enclosure cover;

an electronic device interface removably secured within one of said plurality of nests, further comprising an electronic device cable;

a first ear bud removably secured within one of said plurality of nests, further comprising a first cable;

a second ear bud removably secured within one of said plurality of nests, further comprising a second cable;

a microphone removably secured within one of said plurality of nests and in electrical communication with said second cable;

a unitary reel portion disposed within said enclosure body operably connected to said electronic device interface, said first ear bud, said second ear bud, and said microphone; and, a reel release mechanism operably connected to said reel portion;

wherein said first cable and said second cable are separate and in electrical communication with said electronic interface cable;

wherein each of said first ear bud, said second ear bud, and said microphone are in electrical communication with an electronic device when said electronic device interface is removably attached to and in electrical communication with said electronic device;

wherein each of said electronic device interface, said first ear bud, said second ear bud, and said microphone are secured within one of said plurality of nests such to maintain a consistent outer profile of said enclosure body when each of said plug, said first ear bud, said second ear bud, and said microphone are in said fully retracted state;

wherein said reel portion adjustably lengthens and retracts each of said electronic device interface, said first ear bud, said second ear bud, and said microphone between a fully retracted state and a fully extended state;

wherein said reel portion adjustably secures each of said electronic device interface, said first ear bud, said second ear bud, and said microphone to a desired length;

wherein said reel release mechanism releases each of said electronic device interface, said first ear bud, said second ear bud, and said microphone from said desired length to said fully retracted state;

wherein said reel portion comprises:

a first spool, comprising a first flange pair; and, a second spool, comprising a second flange and a third flange pair;

wherein said first spool is coaxial with said second spool;

wherein said first ear bud and said second ear bud are wound about said second spool while said microphone is wound about said first spool.

11. The device of claim 10, further comprising a name plate located on an outer surface of said cover.

12. The device of claim 10, wherein said enclosure body further comprises:

a cable groove located along a side surface of said enclosure body between a pair of said plurality of nests securing said second ear bud and said microphone therein, said cable groove retaining said second cable therein; and, wherein each of said plurality of nests comprise recessed molded features being shaped so as to provide a retaining interference with each of said corresponding electronic device interface, said first ear bud, said second ear bud, and said microphone portions at or slightly below side and top surfaces of the enclosure body.

13. The device of claim 10, further comprising a plurality of grommets each having a protective bumper located where each of said electronic device cable, said first cable, said second cable enters and exits said enclosure body.

14. The device of claim 10, wherein said reel portion further comprises:

a cylindrical recess portion along a bottom surface;

a stationary axle portion extending vertically along a center axis of and affixed to a top inner surface of said enclosure body and an opposing inner surface of said cover; and, a first spring having an outer end portion affixed to a perimeter surface of said recess and an inner end portion of said first spring affixed to said stationary axle portion;

wherein rotation of said reel portion upon said stationary axle enables coincidental motioning of each of said electronic device interface, said first ear bud, said second ear bud, and said microphone between said fully retracted state and said fully extended state.

15. The device of claim 14, wherein said reel portion further comprises:

a plurality of connecting apertures located on an innermost one of said first flange pair, said second flange, and an innermost one of said third flange pair;

wherein said first spool comprises a diameter larger than a diameter of said second spool;

wherein said first cable and said second cable are coincidentally wound onto said larger first spool between said first flange pair;

wherein said electronic device cable is wound onto said second spool between said third flange pair;

wherein said electronic interface cable and said first cable and said second cable are routed through said plurality of connecting apertures to provide an anchoring and securing means for each of said electronic interface cable, said first cable, and said second cable;

wherein said connecting apertures prevent detachment of said electronic interface cable, said first cable, and said second cable when in said fully extended state;

wherein said second flange is in mechanical communication with said reel release mechanism.

16. The device of claim 15, wherein said reel release mechanism further comprises:

a pin, having a pushbutton located at a top end thereof, said pushbutton extending through an upper wall of said enclosure body and outward therefrom;

a second spring encompassing a lower portion of said pin, residing within a guide tube extending downward from an inner surface of said enclosure body, said second spring biasing said pushbutton upwardly;

a pawl mechanism located at a bottom end of said pin and in mechanical communication with said second flange;

wherein depression of said pushbutton disengages said pawl mechanism from said second flange, thereby enabling said reel portion to return each of said electronic device cable, said first cable, and said second cable to said fully retracted state.

17. The device of claim 16, wherein said second flange and said pawl mechanism each further comprise a plurality of ratchet teeth located along an outer circumference.

18. The device of claim 17, wherein a diametrical ratio between said first spool to said second spool is approximately 4:1.

* * * * *